US005221053A

United States Patent [19]

Pinto et al.

[11] Patent Number: 5,221,053

[45] Date of Patent: Jun. 22, 1993

[54] DEVICE FOR OPENING PRESSED FIBER BALES

[75] Inventors: Akiva Pinto, Duesseldorf-Wittlaer; Guenter Lucassen, Haltern; Reinhard Schmidt, Gescher, all of Fed. Rep. of Germany

[73] Assignee: Hergeth Hollingsworth GmbH, Duelmen, Fed. Rep. of Germany

[21] Appl. No.: 852,163

[22] PCT Filed: Oct. 3, 1990

[86] PCT No.: PCT/EP90/01656

§ 371 Date: Apr. 3, 1992

§ 102(e) Date: Apr. 3, 1992

[87] PCT Pub. No.: WO91/05090

PCT Pub. Date: Apr. 18, 1991

[30] Foreign Application Priority Data

Oct. 5, 1989 [DE] Fed. Rep. of Germany ..... 3933271

[51] Int. Cl.[5] ..... B02C 23/26

[52] U.S. Cl. ..... 241/58; 241/101.7; 241/605; 19/80 R

[58] Field of Search ..... 241/101.7, 58, 57, 605; 19/80 R

[56] References Cited

U.S. PATENT DOCUMENTS 4,595,149 6/1986 Hergeth ..... 241/101 A
4,698,878 10/1987 Buschgens et al. ..... 19/80 R
4,756,059 7/1988 Temburg ..... 19/80 R
4,780,933 11/1988 Pinto et al. ..... 19/80 R
4,785,504 11/1988 Leifeld et al. ..... 19/80 R
4,928,354 5/1990 Hanselmann et al. ..... 19/97
5,090,091 2/1992 Temburg et al. ..... 19/80 R
5,090,629 2/1992 Pinto et al. ..... 241/282.1

FOREIGN PATENT DOCUMENTS 0381186 1/1990 European Pat. Off. .

*Primary Examiner*—Mark Rosenbaum
*Assistant Examiner*—John M. Husar
*Attorney, Agent, or Firm*—Leatherwood Walker Todd & Mann

[57] ABSTRACT

In a device for opening pressed fiber bales material, using at least one milling roller (3,4) acting on the bale surface (20) of the fiber bales, and one pressure roller (18) arranged before and behind the milling roller, respectively, in the moving direction thereof and parallel thereto. A suction hood (21) is arranged above the milling roller (3,4) for sucking off the reduced fibers in an air flow. And air-guide channel (2), provided by a plurality of air-guide sheets (22,26), is arranged between the pressure roller (18) and the milling roller (3,4), extending over the whole length of the milling roller (3,4) and in parallel to the milling and pressure rollers (3,4,18).

12 Claims, 3 Drawing Sheets

DEVICE FOR OPENING PRESSED FIBER BALES

BACKGROUND OF THE INVENTION

The invention is directed to a device for opening pressed fiber bales.

A device for opening pressed fiber bales is known e.g. from German Laid-open 33 34 222. In this state of the art, it was tried to make the suction performance of the opening device independent from the accuracy of the fiber bales placed in a row by improving the guidance of air in the suction hood above the fiber bales.

Due to the large suction performance which previously has been required for obtaining the minimum air speed needed for the removal of reduced fiber flocks, there have been disturbances with respect to the air intake into the reduction device such that accurate reducing of the bale surface has been impaired and adjustment of a definitive reduction quantity has been rendered difficult. The air entering at a high flow speed could even result in a curved shape of the bale surface. FR-A-2572244 describes a device for the opening of pressed fiber bales wherein the suction hood in the lower portion thereof is provided with pivotable side walls adapted for adjusting the distance of the side walls to the milling rollers of the opening device so as to adjust the flow speed of the sucked air. The air guidance in this case is provided exactly such that the sucked air stream is directed almost vertically onto the bale surface and thus generates the above mentioned curved shape of the bale surface.

DE-A-3903238 describes an opening device wherein an air guide sheet of triangular section is arranged between the two milling rollers, said air guide sheet being provided for guiding the air stream between the two milling rollers into the suction hood.

It is the object of the invention to improve a device for opening pressed fiber bales in such a manner that uniformity in reducing the pressed fiber bales is enhanced and the required air quantity is lowered.

The object is solved by the features as discussed below.

SUMMARY OF THE INVENTION

For solving said object, there is provided according to the invention a device for opening pressed fiber bales of spinning material, using at least one milling roller acting on the bale surface of the fiber bales, and one pressure roller arranged before and behind the milling roller, respectively, in the moving direction and being parallel to the milling roller, with a suction hood, having a first air guide sheet, being arranged above the milling roller for sucking off the reduced fibers in an air flow occurring between said first air guide sheet and the pressure roller, wherein an air-guide channel, formed by the first and a second air guide sheet, is arranged between the pressure roller and the milling roller, extending over the whole length of the milling roller and in parallel to the milling and pressure rollers, said air-guide channel guiding the air entering between the pressure roller and the first air guide sheet into a direction substantially parallel to the bale surface.

The air-guide channel, arranged between the pressure roller and the milling roller, advantageously provides a deflection of the sucking air flow, entering at high air speed, into a direction substantially parallel to the bale surface, and thus facilitates the reduction process in the milling area and the removal of the reduced fiber flocks.

The sucking air flow does not impinge anymore directly onto the bale surface in the area between the pressure roller and the milling roller, and it is not possible anymore that this sucking air flow, according to the local density of the pressed fibers, will detach fibers and thus contribute to the formation of craters in the bale surface, which craters can lead to an undesired wave-shape both in longitudinal and lateral direction of the bale surface.

By a second air-guide sheet, the air entering between the pressure roller and the first air-guide sheet is guided into a direction substantially parallel to the bale surface. Thus, the sucking air flow, without having an effect on the bale surface, is guided in such a manner that the flow of air, while moving substantially in parallel to the bale surface, enters tangentially into the milling area and thus contributes to the reducing of the fiber flocks.

By the channeling of the sucking air flow, it is also possible to reduce the required air quantity by changing the flow speeds defined in the air-guide channel. Further, the sucking performance can be reduced since flow losses, caused by turbulences of the sucking air flow, are massively diminished. By the fact that the wave-shape of the surface, generated by the sucking air flow, is reduced, a well-defined constant reduction quantity can be obtained in the milling process.

Preferably, it is provided that the first air-guide sheet guides the sucking air flow, entering above the pressure rollers, through a narrowed portion formed between the pressure roller and the first air-guide sheet. This narrowed passage, having a nozzle-shaped section and extending over the entire length of the milling means, provides a uniform air flow over the length of the milling means.

By a third air-guide sheet, the air circulating with the milling roller is guided, in the peripheral area of the milling roller, to an area close to the bale surface. In this manner, the air circulating with the milling roller is continuously guided until reaching an area close before the bale surface so that this air mixes with the sucked air flow only immediately before the milling area.

The second air-guide sheet can be extended to the peripheral area of the milling roller and thus guides also the air stream flowing tangentially from the third air-guide sheet to the milling roller in a direction substantially parallel to the bale surface.

Further advantageous features of the invention are discussed below.

BRIEF DESCRIPTION OF THE DRAWINGS

An embodiment of the invention will be described in greater detail hereunder with reference to the drawings.

FIG. 1 shows a bale opening device for a plurality of rows of fiber bales arranged side by side. The bale opening device is provided with a tower 10 which, by a carriage 11, can be moved back and forth along the feed of a plurality of rows of fiber bales 7,8,9. To this purpose, guide rails 12 are provided for guiding the wheels (not shown) of carriage 11 thereon. An arm 13 projects from one side of tower 10, having arranged therein a milling device 5 for removing the fiber bales. The milling device 5 can consist of two milling rollers 3,4 driven to rotate about their longitudinal axes. By means of an adjustable advance means, the arm 13 carrying the milling device 5 can be moved up and down in vertical direction according to arrow 15. Below the tower 10 with the carriage 11, there is arranged a channel 16 for receiving and removing the flocks which have been taken off the rows of bales.

Figure 1:
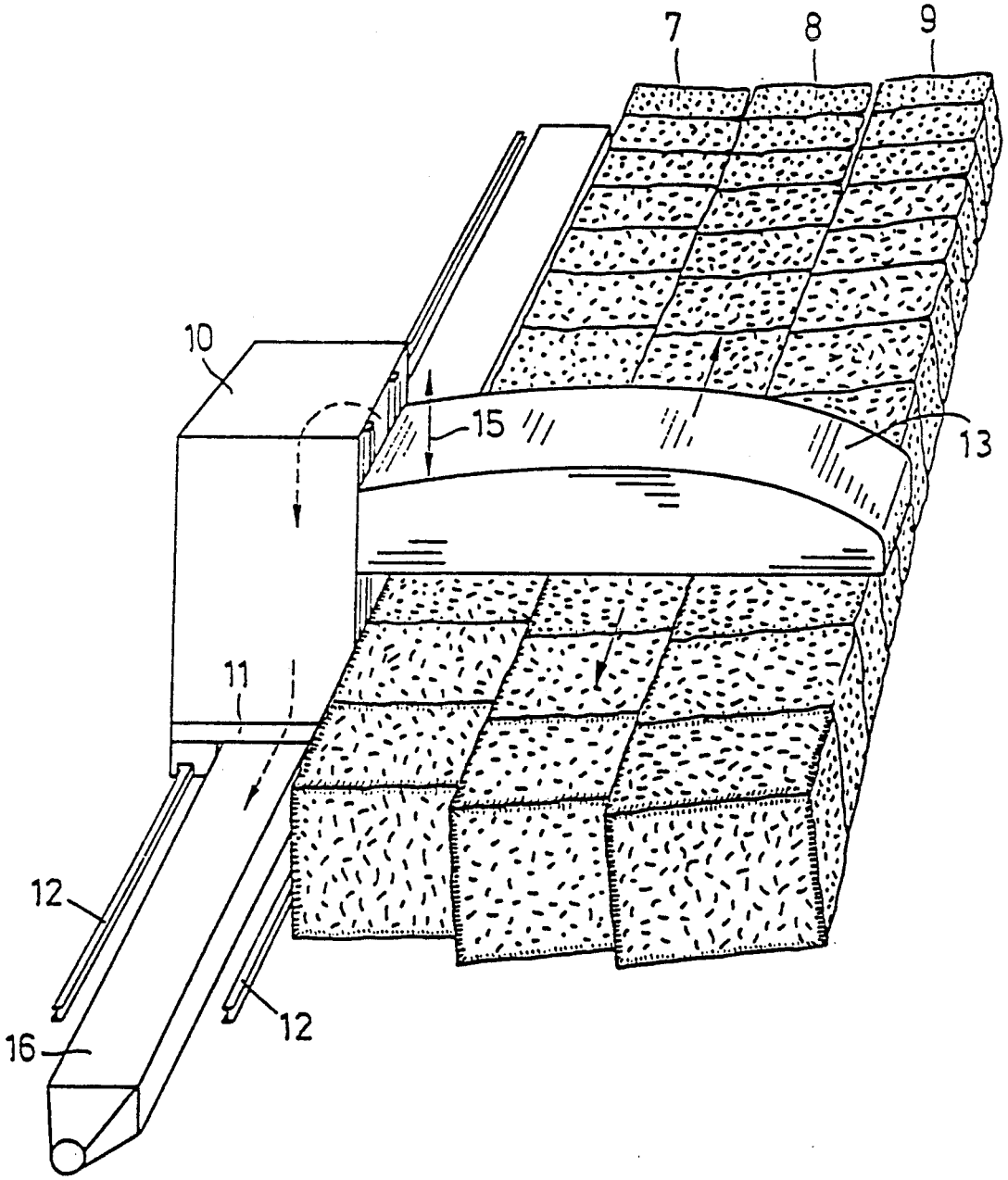
FIG. 1 is a perspective view of a bale opening device.
Figure 2:
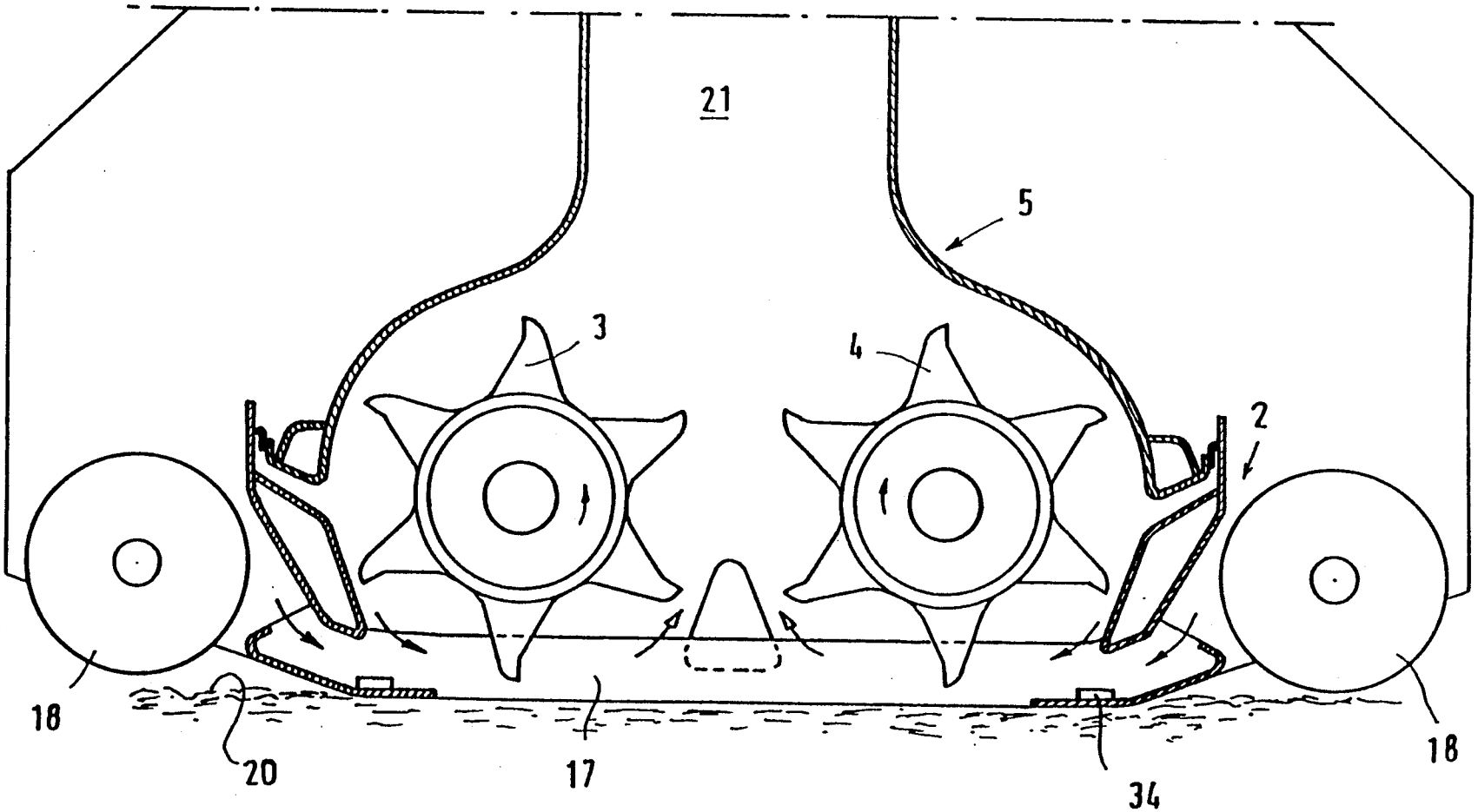
FIG. 2 is a sectional view of the milling device.
Figure 3:
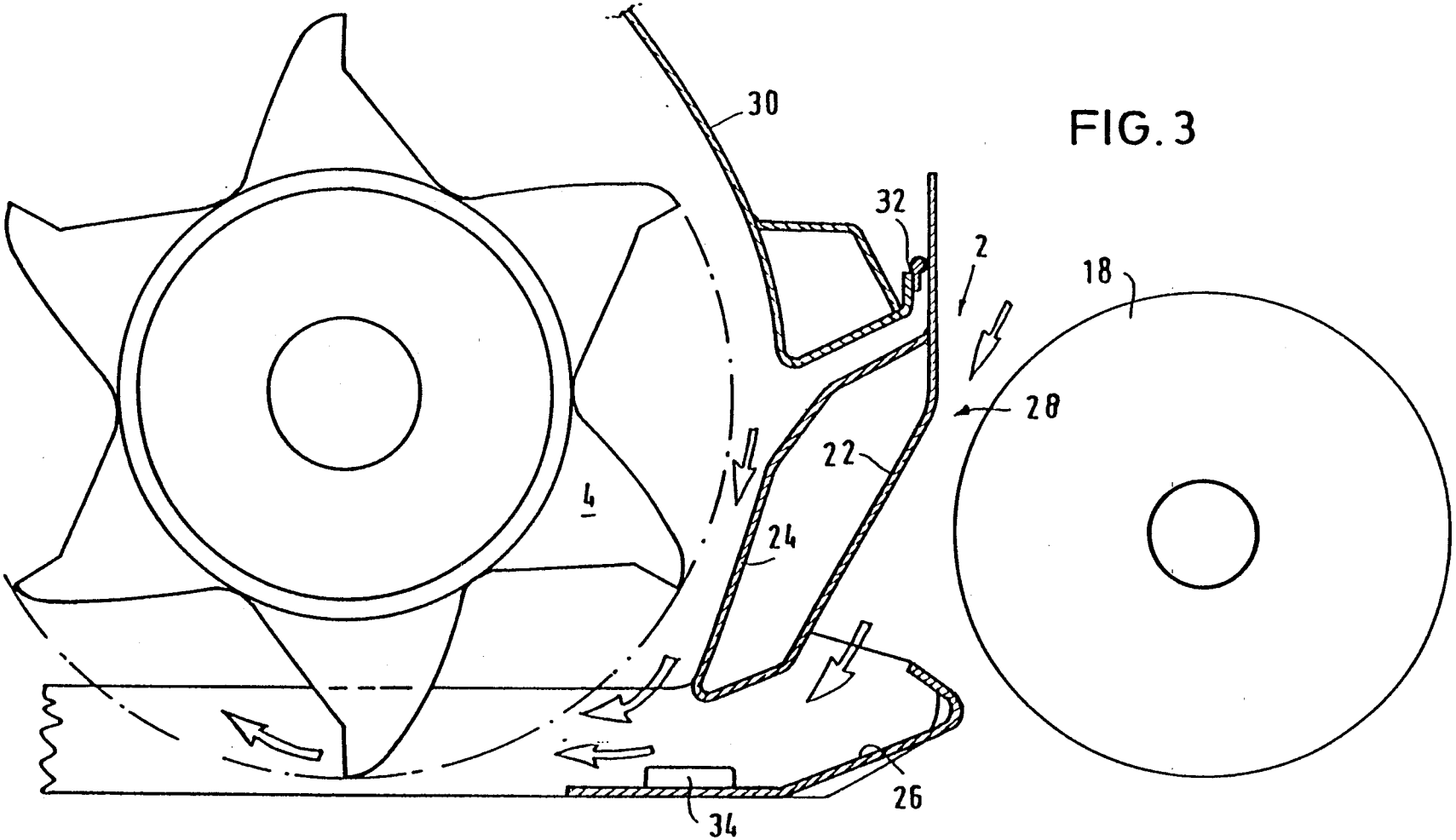
FIG. 3 shows an enlarged portion of FIG. 2.

The milling device 5 consists of two milling rollers 3 and 4 which rotate in opposite senses upwardly to the middle between the pair of rollers and carry off fibers or flocks, respectively, from the bale surface 20, throwing them upwardly between them. A pneumatic suction flow conveys the removed fibers through the suction hood 21 and into the interior of tower 10 wherein a telescopic guide means leads to said lower longitudinal collecting channel 16. As the height of the rows of fiber bales 7,8,9 continuously decreases, the arm 13 with the reduction device 5 is lowered correspondingly.

The housing of the reduction device 5 has provided thereon, in the area of the two milling rollers 3 and 4, a grate 17 consisting of bars. Between these bars, the tooth discs of the milling rollers 3,4 engage into the bale surface 20. Parallel to the milling rollers 3 and 4 and joining the ends of said grate bars 17, pressure rollers 18 are provided.

Between the respective pressure rollers 18 and the milling rollers 3 and 4, respectively, there is arranged an air-guide channel 2 consisting of a plurality of air-guide sheets 22,26 in combination with a pressure roller 18. This air-guide channel 2 extends over the whole width of the milling device 5. To both sides of the milling device 5, one air-guide channel 2 is provided, respectively, so that the air sucked in above the pressure rollers 18 is sucked symmetrically to the middle of the milling device 5 and, from that area, is discharged via suction hood 21.

The first air-guide sheet 22 is sealed against the housing 30 of the milling device 5 by a sealing member 32 so that the entire sucked air flow must enter between the first air-guide sheet 22 and the respective pressure roller 18. Between the respective pressure roller 18 and the bale surface, no air or no air worth mentioning is allowed to pass. The first air-guide sheet 22 is provided with a corner or bend directed towards the pressure roller 18. This bend forms, within the air intake gap, a narrowed portion 28 having a gap width ranging between 10 and 30 mm, preferably between 15 and 20 mm. Thus, the first air-guide sheet 22 together with the pressure roller 18 provides an air intake slot of nozzle-shaped section, which slot has a funnel-like widening portion before and behind the narrowed portion 28, respectively. In this first area of the air-intake channel 2, the air flow can enter under an angle of about 45° to 70° to the bale surface.

A third air-guide sheet 24 is arranged in the peripheral area of milling roller 3 and 4, respectively. This third air-guide sheet 24 joins the housing wall 30 surrounding milling roller 3 and 4, respectively, and allows the air flow circulating with the milling roller 3 and 4, respectively, to be tangentially guided to a position near the bale surface 20, i.e. to the suction air stream through air-guide channel 2. The air-guide sheet 24, extending also over the entire length of the milling device 5, can consist of a sheet having a linear section or also of a curved sheet being parallel to the line of engagement of the milling roller discs.

Preferably, the first air-guide sheet 22 and the third air-guide sheet 24, as seen in section, provide a closed profile.

A second air-guide sheet 26 is arranged below the entering air flow and serves for guiding the air flow into a direction substantially parallel to the bale surface 20, namely towards the milling rollers 3 or 4, respectively. To this purpose, the second air-guide sheet 26 can have a bent or arcuate shape so that, in consideration of the angle under which the incoming flow enters, guidance is effected with the lowest possible pressure losses and without air turbulances. Preferably, the portion of the second air-guide sheet 26 downstream of the air-guide channel 2 is oriented parallel to the bale surface 20 and abuts on this bale surface.

Advantageously, the second air-guide sheet 26 and the box composed of the first and third air-guide sheets 22,24 is fastend to the grate bars 17.

The second air-guide sheet 26, by its portion parallel to the bale surface 20, extends so far in the direction of the milling roller 3 or 4, respectively, that also the air flow circulating with the milling roller 4 does not impinge immediately onto the bale surface 20 but is deflected by the second air-guide sheet 26. By the fact that the circulating air flow is continuously guided by the third air-guide sheet 24 to air-guide channel 2 and, thereat, impinges onto the suction flow having already been deflected into a substantially horizontal direction, the angle between these two air streams, being substantially oriented in the same direction, is reduced in such a manner that the formation of air turbulances is reduced.

The decrease of pressure losses and turbulances has the effect that the sucking of the reduced fiber flocks can be performed with less suction force and with a reduced suction air stream.

In the crossing area of the air flow circulating with the milling rollers 3 or 4, respectively, and the sucked-in air flow, there is provided, on the side of the grate 17 or, respectively, the second air-guide sheet 26 and facing away from the bale surface, a magnetic separator 34 extending over the whole length of the milling device 5. This magnetic separator 34 collects smaller metallic particles, particularly from the air flow circulating with the milling roller 3 or 4, respectively.

The features of the present invention as disclosed in the above description, in the drawings and in the claims, even if described only in connection with a specific embodiment, are to be considered essential of the realization of the invention in its different embodiments, both individually and in any desired combination of features.

We claim:

1. A device for opening pressed fiber bales, comprising:

at least one milling roller for contacting the top surfaces of the fiber bales to remove fibers therefrom;

a first pressure roller, and a second pressure roller spaced apart from said first pressure roller; said milling roller being interposed between said first and second pressure rollers;

suction means associated with said milling roller for sucking fibers removed from the pressed fiber bales, said suction means having a first air-guide sheet, said suction means creating a suction air flow extending longitudinally between said first air-guide sheet and substantially the length of at least one of said first and second pressure rollers;

a second longitudinally extending air-guide sheet associated with said suction means and adjacent to said first air-guide sheet, said first and second air-guide sheets together forming an air-guide channel between said milling roller and at least one of said first and second pressure rollers, said air-guide channel extending substantially the length of said milling roller, such that said air-guide channel guides air transversely between said first air-guide sheet and at least one of said first and second pressure rollers into a direction towards said milling roller and substantially parallel to the top surfaces of the pressed fiber bales.

2. The device according to claim 1, wherein the first air-guide sheet guides the air flow from above, and through a narrowed portion formed between at least one of said first and second pressure rollers and the first air guide sheet.

3. The device according to claim 2, wherein the narrowed portion has a gap width ranging between and 30 mm.

4. The device according to claim 2, wherein the narrowed portion has a gap width between 15 and 20 mm.

5. The device according to claim 1, wherein the second air-guide sheet extends at least partially in parallel with the bale surfaces.

6. The device according to claim 1, further comprising a third air-guide sheet associated with said suction means and wherein the second air-guide sheet extends to the peripheral area of the milling roller and guides the air flow tangentially from the third air-guide sheet.

7. The device according to claim 6, wherein the first and third air-guide sheets, provide a closed profile.

8. The device according to claim 6, further comprising a magnetic separator arranged in an area where the air flow sucked from the air-guide channel and the air flowing tangentially to the milling roller meet.

9. The device according to claim 1, further comprising a grate associated with the milling roller having bars, wherein said milling roller includes toothed discs which engage the pressed fiber bales through said grate, the second air-guide sheet being fastened flush with a lower edge of the grate.

10. A device according to claim 1, wherein said first and second pressure rollers and said milling roller all extend substantially parallel to one another.

11. The device according to claim 1, wherein said second air-guide sheet extends substantially parallel to said milling roller and said first and second pressure rollers.

12. The device according to claim 1, further comprising an air-guide sheet associated with said suction means for guiding air from the peripheral area of said milling roller tangentially to the area of contact of the milling roller with the surfaces of the pressed fiber bales.

* * * * *